US008339353B2

(12) United States Patent
Kim

(10) Patent No.: US 8,339,353 B2
(45) Date of Patent: Dec. 25, 2012

(54) DATA TRANSMISSION APPARATUS

(75) Inventor: Sang-Seob Kim, Suwon-si (KR)

(73) Assignee: Dongbu HiTek Co., Ltd., Seoul (KR)

( * ) Notice: Subject to any disclaimer, the term of this patent is extended or adjusted under 35 U.S.C. 154(b) by 548 days.

(21) Appl. No.: 12/635,560

(22) Filed: Dec. 10, 2009

(65) Prior Publication Data

US 2010/0164853 A1 Jul. 1, 2010

(30) Foreign Application Priority Data

Dec. 29, 2008 (KR) ..... 10-2008-0135770

(51) Int. Cl.
*G09G 3/36* (2006.01)

(52) U.S. Cl. ..... 345/99; 375/354

(58) Field of Classification Search ..... None
See application file for complete search history.

(56) References Cited

U.S. PATENT DOCUMENTS 6,973,149 B2 * 12/2005 Fyvie ..... 375/364
7,508,893 B1 * 3/2009 Gan et al. ..... 375/355
7,561,490 B2 * 7/2009 Kim et al. ..... 365/233.11
7,573,968 B2 * 8/2009 Natsume ..... 375/371
7,751,519 B2 * 7/2010 Farbarik et al. ..... 375/371
2004/0047441 A1 * 3/2004 Gauthier et al. ..... 375/376
2005/0008111 A1 * 1/2005 Suzuki ..... 375/371
2005/0018760 A1 * 1/2005 Smith et al. ..... 375/215

* cited by examiner

*Primary Examiner* — Jason Olson
(74) *Attorney, Agent, or Firm* — Sherr & Jiang, PLLC

(57) ABSTRACT

A data transmission apparatus may include a delay locked loop for generating multi-phase clock signals synchronized to an input clock signal. A clock selector may select the multi-phase clock signals in response to a selection signal. A modulation controller may generate the selection signal using the input clock signal and modulation information, so that the clock selector selects the multi-phase clock signals within every predetermined interval. A clock generator may generate first and second latch clock signals according to the selected multi-phase clock signals. A data transmitter may transmit input data using the first and second latch clock signals. Therefore, the data transmission apparatus mitigates at least as much EMI as a related data transmission apparatus using spread spectrum clock generation for EMI mitigation, eliminates the probability of data error, and saves an IC area. It obviates the need for a FIFO memory, thus contributing miniaturization of the IC. The spread spectrum clock generation function of the related data transmission apparatus may be implemented inside the IC, thus increasing throughput.

20 Claims, 4 Drawing Sheets

DATA TRANSMISSION APPARATUS

The present application claims priority under 35 U.S.C. 119 to Korean Patent Application No. 10-2008-0135770 (filed on Dec. 29, 2008), which is hereby incorporated by reference in its entirety.

BACKGROUND

Electro-Magnetic Interference (EMI) has emerged as a challenging issue to tackle in the field of digital products including Flat Panel Displays (FPDs) that have been increased in their sizes and usages. Along with an increase in the resolution of displays such as TV or monitors, the demand for transmission of more and more data is also on the increase.

For example, when data is transmitted at high data rate to meet the demand for large-scale data transmission, much EMI occurs. The EMI is especially great at a transmission line in which data signals are transmitted between a timing controller and a source driver in a column driving Integrated Circuit in an FPD.

Among methods for overcoming EMI, there is a method for distributing the EMI of a specific frequency band to adjacent frequency bands by spreading the frequency of a synchronization clock signal of a logic circuit. This is called spread spectrum clock generation.

Figure 1:
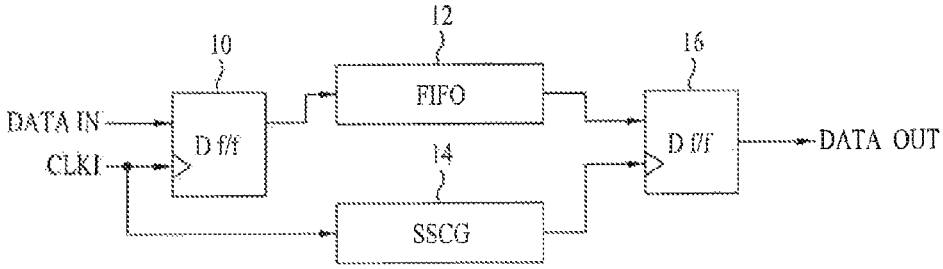
FIG. 1 (Related Art)

FIG. 1 is a block diagram of a related data transmission apparatus using spread spectrum clock generation. Referring to FIG. 1, the transmitter includes D flip-flops (f/fs) 10 and 16, a First Input First Output (FIFO) memory 12, and a Spread Spectrum Clock Generator (SSCG) 14. The D f/f 10 outputs input data to the FIFO memory 12 in response to a first latch clock signal CLKI.

The data transmission apparatus illustrated in FIG. 1 is used in the timing controller of a related FPD. The data transmission apparatus may use the SSCG 14 inside or outside of the IC in order to decrease an overall EMI level by spreading the EMI of a specific frequency caused by the first latch clock signal CLKI band to adjacent frequency bands.

To prevent data transmission errors that may be generated due to a changed clock domain, the data transmission apparatus further includes the FIFO memory 12 for storing a predetermined amount of data. The size of the FIFO memory 12 is determined according to a modulation frequency and a modulation rate that controls the SSCG 14.

Figure 2:
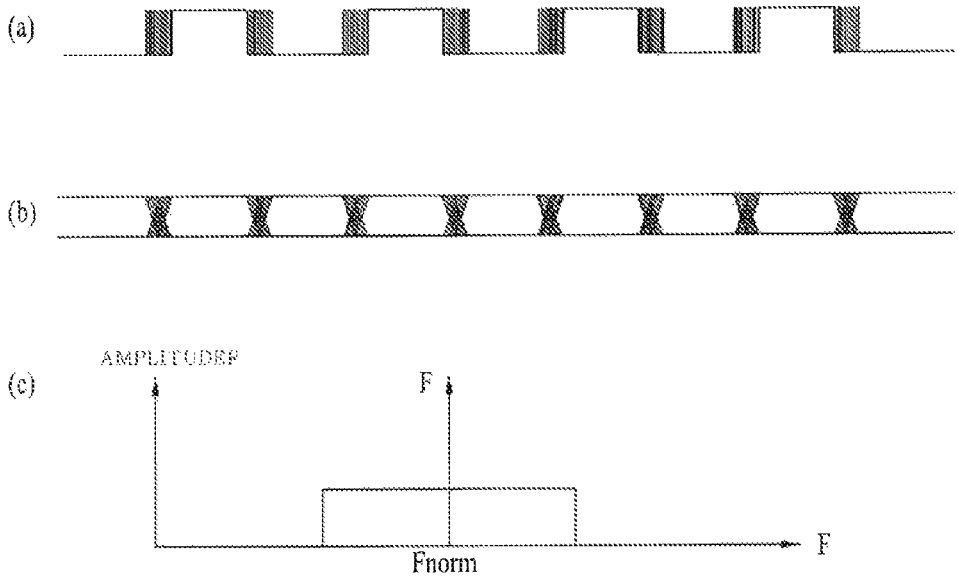
FIG. 2 (Related Art)

FIGS. 2(*a*), 2(*b*) and 2(*c*) are waveform diagrams of components illustrated in FIG. 1. FIG. 2(*a*) is a waveform diagram of a second latch clock signal generated from the SSCG 14, FIG. 2(*b*) is a waveform diagram of data output from the D f/f 10, and FIG. 2(*c*) illustrates the spectrum of the second latch clock signal. In FIG. 2(*c*), the horizontal axis represents frequency and the vertical axis represents signal amplitude, i.e. signal level.

Referring to FIGS. 2(*a*), 2(*b*) and 2(*c*), it is noted from an output modulation signal and its frequency spectrum that the data transmission apparatus illustrated in FIG. 1 mitigates EMI by use of the SSCG 14. That is, the afore-mentioned effect of spread spectrum is observed. However, the related data transmission apparatus suffers from the following drawbacks.

In the data transmission apparatus illustrated in FIG. 1, the input and output of the SSCG 14 are inevitably in different synchronization clock domains. Accordingly, the FIFO memory 12 is required to be of an infinite size in theory. Even though only a specific amount of data can be stored in the FIFO memory 12 by restricting the modulation frequency and the modulation rate, data transmission is enabled.

However, available modulation frequencies and modulation rates are limited. Moreover, to secure a modulation frequency and modulation rate of a specific level for EMI mitigation, the capacity of the FIFO memory 12 must be sufficient. Use of an FIFO memory 12 with insufficient capacity leads to data transmission errors. Considering that a modulation frequency ranges from tens of kHz to hundreds of kHz and a modulation rate is several %, a large memory space is required. Consequently, the FIFO memory 12 must increase in size.

In addition, the related data transmission apparatus described above has the SSCG 14 outside of the IC, for frequency modulation of a synchronization clock signal. Thus, the overall throughput of a product decreases. Even if the SSCG 14 is integrated into the IC, the size of the SSCG 14 increases due to the FIFO memory 12, thereby decreasing product competitiveness and throughput.

SUMMARY

Embodiments relate to data transmission, and more particularly, to a data transmission apparatus associated with spread spectrum clock generation. Embodiments relate to a data transmission apparatus for transmitting data using a Spread Spectrum Clock (SSC) signal as a new scheme for EMI mitigation.

Embodiments relate to a data transmission apparatus which may include A data transmission apparatus may include a delay locked loop for generating multi-phase clock signals synchronized to an input clock signal. A clock selector may select the multi-phase clock signals in response to a selection signal. A modulation controller may generate the selection signal using the input clock signal and modulation information, so that the clock selector selects the multi-phase clock signals within every predetermined interval. A clock generator may generate first and second latch clock signals according to the selected multi-phase clock signals. A data transmitter may transmit input data using the first and second latch clock signals.

A method may include generating multi-phase clock signals synchronized to an input clock signal; selecting the multi-phase clock signals in response to a selection signal; generating the selection signal using the input clock signal and modulation information, so that the multi-phase clock signals are selected within every predetermined interval; generating first and second latch clock signals according to the selected multi-phase clock signals; and transmitting input data using the first and second latch clock signals.

DRAWINGS

FIG. 1 is a related art block diagram of a related data transmission apparatus using spread spectrum clock generation.

FIGS. 2(*a*), 2(*b*) and 2(*c*) are related art waveform diagrams of components illustrated in FIG. 1.

Figure 3:
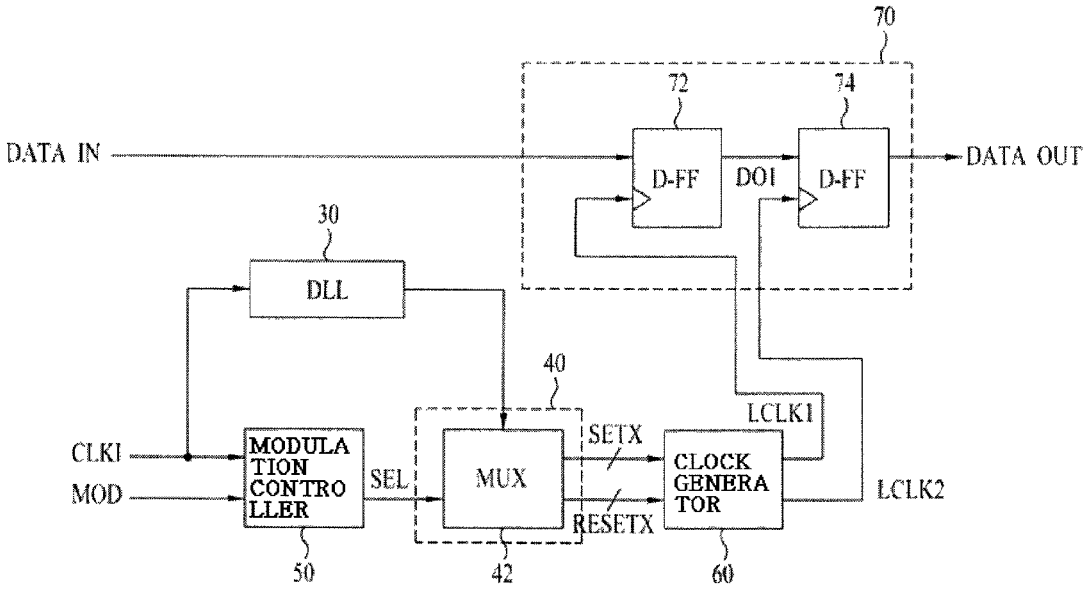

Example FIG. 3 is a block diagram of a data transmission apparatus according to embodiments.

Figure 4:
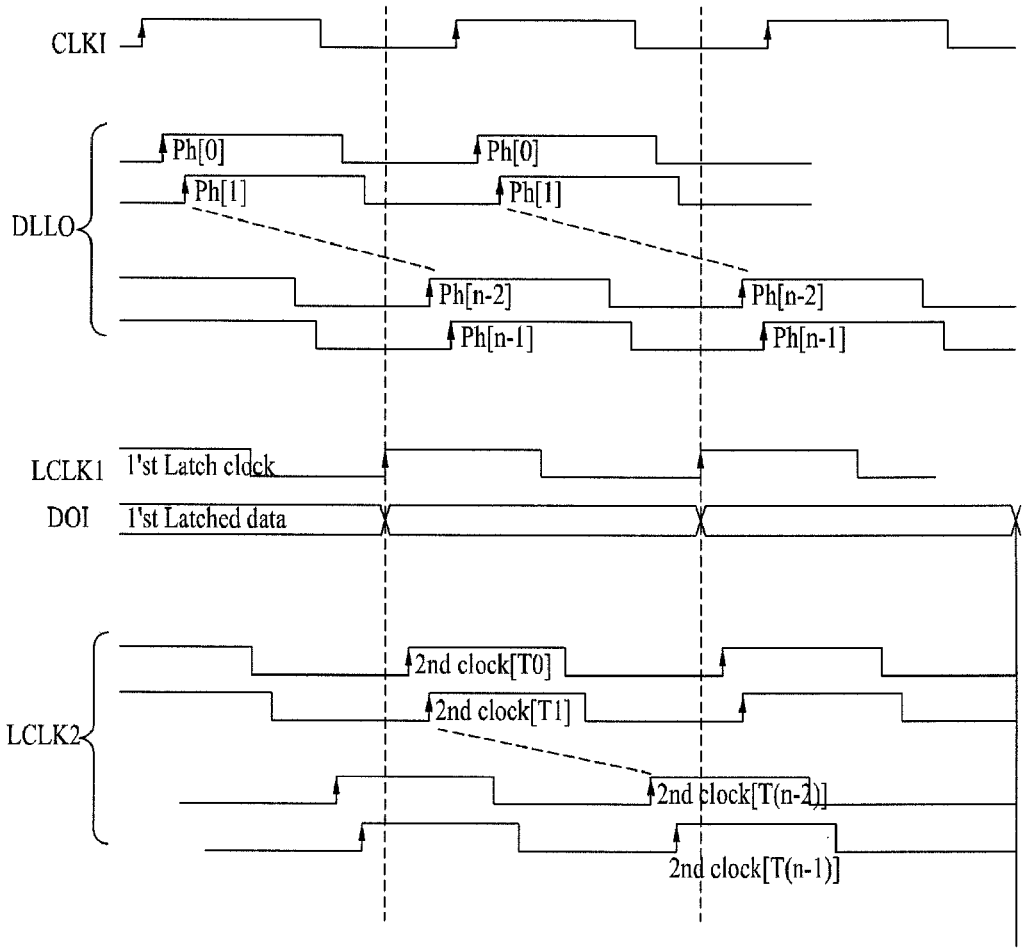

Example FIG. 4 illustrates the waveforms of signals in components illustrated in example

FIG. 3.

Figure 5:
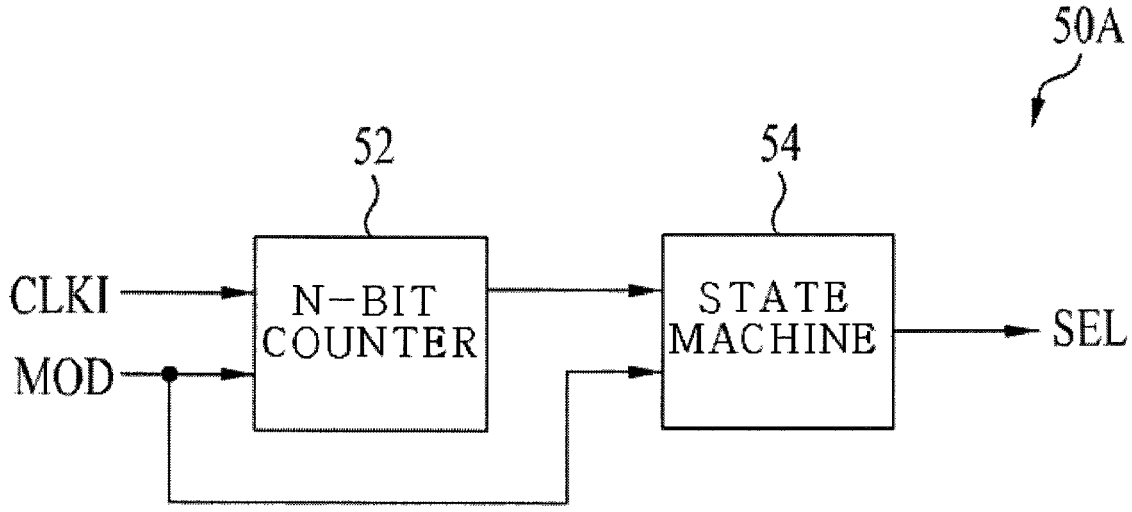

Example FIG. 5 is a block diagram of a modulation controller illustrated in example FIG. 3 according to embodiments.

Figure 6:
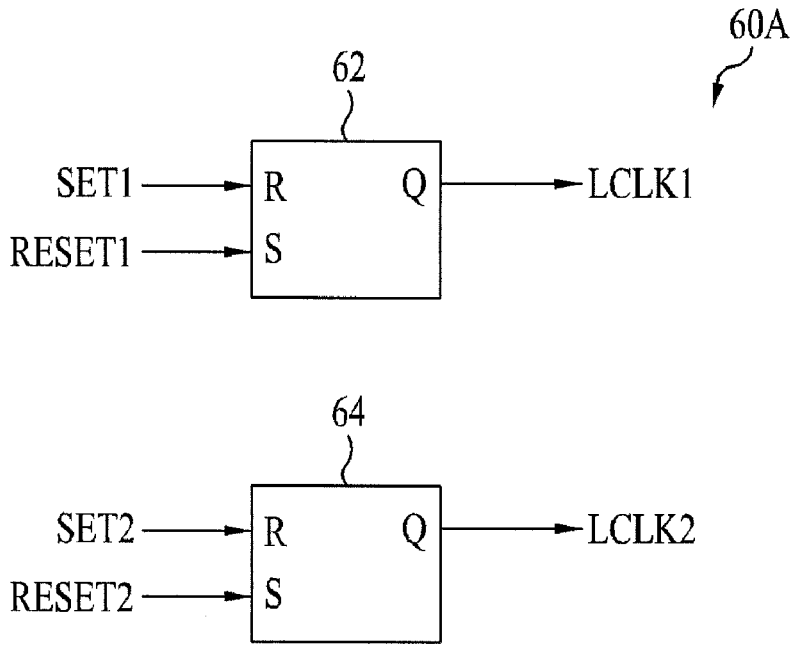

Example FIG. 6 is a block diagram of a clock generator illustrated in example FIG. 3 according to embodiments.

DESCRIPTION

A data transmission apparatus according to embodiments will be described below. Example FIG. 3 is a block diagram of a data transmission apparatus according to embodiments. The data transmission apparatus illustrated in example FIG. 3 may include a Delay Locked Loop (DLL) 30, a clock selector 40, a modulation controller 50, a clock generator 60, and a data transmitter 70.

Example FIG. 4 illustrates the waveforms of signals in components illustrated in example FIG. 3. Reference character CLKI denotes an input clock signal, reference character DLLO denotes the output of the DLL 30, reference character LCLK1 denotes a first latch clock signal, reference character DO1 denotes the output of a D flip-flop (D-FF) 72, and reference character LCLK2 denotes a second latch clock signal.

The DLL 30 may first generate multi-phase clock signals synchronized to the input clock signal CLKI and outputs the multi-phase clock signals to the clock selector 40. For instance, the DLL 30 may delay the input clock signal CLKI by predetermined intervals, as illustrated in example FIG. 4, and output the delayed input clock signals as the multi-phase clock signals.

The clock selector 40 may select the multi-phase clock signals in response to a selection signal SEL received from the modulation controller 50 and output the selected multi-phase clock signals to the clock generator 60. For the clock signal selection, the clock generator 40 may be configured with a Multiplexer (MUX) 42. That is, the MUX 42 multiplexes the multi-phase clock signals in response to the selection signal SEL and outputs the multiplexed clock signals.

The modulation controller 50 may generate the selection signal SEL using the input clock signal CLKI and modulation information MOD, and output the selection signal SEL to the clock selector 40. Therefore, the multi-phase clock signals can be selected at every predetermined interval in response to the selection signal SEL in the clock selector 40.

Example FIG. 5 is a block diagram of embodiments, in particular 50A of the modulation controller 50, illustrated in example FIG. 3. Referring to example FIG. 5, the modulation controller 50A may include an N-bit counter 52 and a state machine 54. The N-bit counter 52 determines the number of bits to be counted, N, according to the modulation information MOD and counts as many pulses of the input clock signal CLKI as N bits. For example, the N-bit counter 52 counts the number of rising edges of the input clock signal CLKI and determines the count as the number of pulses of the input clock signal CLKI.

The state machine 54 may change MUX information of a current state to MUX information of a next state. For the MUX to change the information, the state machine 54 may determine the number of states according to the modulation information MOD, change as many states as the determined number according to a count received from the N-bit counter 52, and output the changed result as the selection signal SEL.

The clock generator 60 may generate the first latch clock signal LCLK1 and the second latch clock signal LCLK2 according to the selection of the clock selector 40, as illustrated in example FIG. 4, and provide the first and second latch clock signals LCLK1 and LCLK2 to the data transmitter 70.

Example FIG. 6 is a block diagram of an exemplary embodiment 60A of the clock generator 60 illustrated in example FIG. 3. Referring to example FIG. 6, the clock generator 60A may include first and second SR flip-flops 62 and 64. The first SR flip-flop 62 may include a reset terminal R and a set terminal S for receiving reset and set components RESET1 and SET1 of clock signals with fixed phases among the multi-phase clock signals selected by the clock selector 40, and a positive output terminal Q for outputting the first latch clock signal LCLK1 illustrated in example FIG. 4.

The second SR flip-flop 64 may include a reset terminal R and a set terminal S for receiving reset and set components RESET1 and SET1 of clock signals with phases that periodically vary according to the modulation information MOD among the multi-phase clock signals selected by the clock selector 40, and a positive output terminal Q for outputting the second latch clock signal LCLK2 illustrated in example FIG. 4.

The data transmitter 70 may transmit input data DATAIN using the first and second latch clock signals LCLK1 and LCLK2 received from the clock generator 60 as synchronization clock signals. For this purpose, the data transmitter 70 may include first and second D-FFs 72 and 74. The first D-FF 72 may receive the input data illustrated in example FIG. 4 through a data input terminal in response to the first latch clock signal LCLK1, and output data DO1 that has been latched once as illustrated in example FIG. 4 through the positive output terminal Q. The second D-FF 74 may receive the data DO1 that has been latched once as illustrated in example FIG. 4 in response to the second latch clock signal LCLK2, and output data DATAOUT through a positive output terminal Q.

In the above-described data transmission apparatus, the phases of the input data DATAIN and the final output synchronization clock signal LCLK2 may be modulated according to the same modulation information MOD due to the phase-modulated clock signal LCLK2 having a predetermined period. Therefore, the data transmission apparatus can perform at least as well as the related data transmission apparatus which time-spreads the output frequency of the SCSG 14, in terms of EMI mitigation.

While the related data transmission apparatus uses the SSCG 14, which adopts a PLL, it suffers from a high probability of data error due to a discrepancy in clock domain. The data transmission apparatus of embodiments fundamentally avoids the clock domain discrepancy by use of the DLL 30, thereby eliminating the probability of data error.

Also, the data transmission apparatus of embodiments obviates the need for a buffer memory such as the FIFO memory 12 that is added to the related data transmission apparatus using the SSCG 14 to reduce the probability of data error caused by the clock domain discrepancy. Therefore, despite integration of the data transmission apparatus on an IC, the area of the IC can be reduced considerably. Compared to the related data transmission apparatus occupying a rather large area due to the use of the PLL-based SSCG 14, embodiments instead use the DLL 30 requiring a small area, which makes it possible to implement an SSCG function that might otherwise be performed externally, inside the IC. As a result, a large IC area is saved. The data transmission apparatus of embodiments may be incorporated into a timing controller of an FPD.

It will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. An apparatus comprising:

a delay locked loop for generating multi-phase clock signals synchronized to an input clock signal;

a clock selector for selecting the multi-phase clock signals in response to a selection signal;

a modulation controller for generating the selection signal using the input clock signal and modulation information, so that the clock selector selects the multi-phase clock signals within every predetermined interval;

a clock generator for generating first and second latch clock signals according to the selected multi-phase clock signals; and a data transmitter for transmitting input data using the first and second latch clock signals.

2. The apparatus of claim 1, wherein the modulation controller includes an N-bit counter.

3. The apparatus of claim 2, wherein the N-bit counter counts pulses of the input clock signal up to N bits, with N being determined according to the modulation information.

4. The apparatus of claim 2, wherein the modulation controller includes a state machine.

5. The apparatus of claim 4, wherein the state machine changes among as many states as determined according to the modulation information based on the count received from the N-bit counter.

6. The apparatus of claim 1, wherein the clock generator includes a first SR flip-flop and a second SR flip-flop.

7. The apparatus of claim 6, wherein the first SR flip-flop includes a reset terminal for receiving reset components of clock signals having fixed phases among the selected multi-phase clock signals, a set terminal for receiving set components of the clock signals having the fixed phases, and a positive output terminal for outputting the first latch clock signal.

8. The apparatus of claim 6, wherein the second SR flip-flop includes a reset terminal for receiving reset components of clock signals having phases reflecting the modulation information among the selected multi-phase clock signals, a set terminal for receiving set components of the clock signals having the phases reflecting the modulation information, and a positive output terminal for outputting the second latch clock signal.

9. The apparatus of claim 1, wherein the data transmitter includes:

a first D flip-flop and a second D flip-flop.

10. The apparatus of claim 9, wherein the first D flip-flop outputs the input data in response to the first latch clock signal.

11. The apparatus of claim 10, wherein the second D flip-flop outputs the output of the first D flip-flop as output data in response to the second latch clock signal.

12. The apparatus of claim 2, wherein the N-bit counter counts the number of rising edges of the input clock signal as the number of pulses of the input clock signal.

13. The apparatus of claim 1, wherein the data transmission apparatus is included in a timing controller of a flat panel display.

14. A method comprising:

generating multi-phase clock signals synchronized to an input clock signal;

selecting the multi-phase clock signals in response to a selection signal;

generating the selection signal using the input clock signal and modulation information, so that the multi-phase clock signals are selected within every predetermined interval;

generating first and second latch clock signals according to the selected multi-phase clock signals; and transmitting input data using the first and second latch clock signals.

15. The method of claim 14, including counting pulses of the input clock signal up to N bits, with N being determined according to the modulation information.

16. The method of claim 14, including:

receiving reset components of clock signals having fixed phases among the selected multi-phase clock signals;

receiving set components of the clock signals having the fixed phases; and outputting a first latch clock signal.

17. The method of claim 16, including:

receiving reset components of clock signals having phases reflecting the modulation information among the selected multi-phase clock signals;

receiving set components of the clock signals having the phases reflecting the modulation information; and outputting a second latch clock signal.

18. The method of claim 17, including latching and outputting the input data in response to the first latch clock signal.

19. The method of claim 18, including latching and outputting the previously latched and output data in response to the second latch clock signal.

20. The method of claim 14, including counting the number of rising edges of the input clock signal as the number of pulses of the input clock signal.

* * * * *